US005078632A

United States Patent [19]

Ogawa et al.

[11] Patent Number: 5,078,632

[45] Date of Patent: Jan. 7, 1992

[54] MOTORBOAT PROPELLER

[75] Inventors: Toshimitsu Ogawa, Tokyo; Shouichi Takahara, Yokohama; Hideo Tahara, Yokosuka, all of Japan

[73] Assignee: Nissan Motor Co., Ltd., Yokohama, Japan

[21] Appl. No.: 569,143

[22] Filed: Aug. 17, 1990

[30] Foreign Application Priority Data

Aug. 18, 1989 [JP] Japan ..... 1-212565

[51] Int. Cl.[5] ..... B63H 21/32

[52] U.S. Cl. ..... 440/89; 416/201 R; 440/81

[58] Field of Search ..... 440/89, 49, 79, 80, 440/81; 416/201 R, 201 A, 245 R, 245 A, 93 A; 415/143, 218

[56] References Cited

U.S. PATENT DOCUMENTS 3,520,270 7/1970 Miller ..... 440/89

FOREIGN PATENT DOCUMENTS 56-30195 3/1981 Japan .
57-139500 8/1982 Japan .
2-63994 3/1990 Japan .
17711 of 1908 United Kingdom ..... 416/201 A
2194295 3/1988 United Kingdom ..... 416/93 A

*Primary Examiner*—Jesus D. Sotelo
*Attorney, Agent, or Firm*—Foley & Lardner

[57] ABSTRACT

To reduce engine exhaust gas pressure behind a motorboat propeller formed with a boss for educing engine exhaust gas therethrough, without forming a trumpet-shaped boss end and without allowing exhaust gas to flow upstream along the boss outer surface, a single or plural small subblades are provided between two adjacent large main blades at such a position that a positive pressure domain produced by the subblade reduces a negative pressure domain produced by the main blade. Since engine exhaust gas can be effectively educed, engine power increases and therefore motorboat acceleration performance can be improved.

7 Claims, 12 Drawing Sheets

FIG. 9(A)

TABLE 1

| PRESSURE / PROPELLER | NEGATIVE BOSS P | POSITIVE PROPULSION P | NEGATIVE CENTRIFUGAL ACCELERATION P | TOTAL PRESSURE P BEHIND PROPELLER |
|---|---|---|---|---|
| PRIOR-ART 1 | ⊖ | ⊕ | ⊖ | ⊖ |
| PRIOR-ART 2 | ⊖ ⊖ | ⊕ | ⊖ | ⊖ ⊖ |
| INVENTION | ⊖ | ⊕ | ⊖ ⊖ | ⊖ ⊖ |

⊕ POSITIVE PRESSURE DOMAIN
⊖ NEGATIVE PRESSURE DOMAIN

FIG. 9(B)

TABLE 2

| PROPELLER | ACTUAL EXHAUST GAS PRESSURE VALUE (mmHg) | | |
|---|---|---|---|
| | POINT: A | POINT: B | PRESSURE DIFFERENCE BETEEN A AND B |
| PRIOR-ART 1 | 190 | 175 | 15 |
| PRIOR-ART 2 | 122 | 84 | 38 |
| INVENTION | 137 | 76 | 61 |

FIG. 9(C)

TABLE 3

| PROPELLER | FLUID (BOSS) RESISTANCE | EXHAUST GAS UPSTREAM FLOW | TOTAL POSITIVE P BEHIND PROPPELLER | TOTAL PROPELLER PERFORMANCE |
|---|---|---|---|---|
| PRIOR-ART 1 | ○ | × | × | × |
| PRIOR-ART 2 | × | ○ | ○ | △ |
| INVENTION | ○ | ○ | ○ | ○ |

○: BEST
×: POOR
△: GOOD

MOTORBOAT PROPELLER

BACKGROUND OF THE INVENTION

1. Field of the Invention

The present invention relates to a motorboat propeller, and more specifically to a high-speed motorboat propeller formed with a cylindrical boss through which engine exhaust gas is educed directly into water.

2. Description of the Prior Art

Conventionally, high-speed motorboat propellers formed with a cylindrical boss through the inner hollow space of which engine exhaust gas is educed directly into water have been well known, because these propellers have such advantages that exhaust sound can be reduced; exhaust smoke will not be seen; and exhaust pipe end will not be contaminated by soot.

FIG. 1(A) and (B) show a first example of prior-art motorboat propellers formed with the exhaust boss, in which the propeller comprises a boss 2 and three blades 3 fixed to the outer surface of the boss 2 at regular angular intervals. Further, an exhaust passage 4 is formed within the boss 2 to educe engine exhaust gas introduced from an engine into water from a rearmost end of the boss 2.

FIG. 1(C) is a development view taken along the outer circumferential surface of the boss 2, in which water 12 flows against the blade 3 at an elevation angle $\alpha$ with respect to the blade 3 when the blade 3 is assumed to be fixed. In FIG. 1(C), $Z_{p1}$ denotes a deviation pressure distribution domain in which negative (−) and positive (+) pressure (deviated from the roughly atmospheric pressure) is produced by water 12 flowing against the blade 3. In FIG. 1(C), when taking into account exhaust gas flow 14 along a generatrix G1 on the outer surface of the boss 2, there exists a problem in that the propulsion efficiency is reduced, because exhaust gas 14 educed from the rearmost end of the boss 2 through a point 13 flows upstream into the negative pressure (vacuum) domain near the outer surface of the boss 2 and further is sucked into a back surface 3*a* of the blade 3. In this connection, exhaust gas flow 14 along another generatrix G2 on the outer surface of the boss 2 through a point 15 can smoothly flow downstream. In summary, there exists a problem in that exhaust gas flow 14 passing through the negative pressure domain produced by the blade 3 flows upstream along the outer surface of the boss 2.

FIGS. 2(A) and (B) show a second example of prior-art motorboat propellers formed with an exhaust boss, in which a trumpet-shaped portion 5 is formed at the rearmost end of the boss 2 in order to reduce exhaust gas pressure at the boss rear end. In this example, since water flows against the trumpet-shaped portion 5, an additional annular positive pressure domain $Z_t$ is produced as shown in FIG. 2(C), so that it is possible to reduce the area of the negative and positive pressure domain as designated b $Z_{p2}$, as compared with that $Z_{p1}$ shown in FIG. 1(C). In other words, it is possible to prevent the exhaust gas flow 14 along the generatrix G1 from flowing upstream, and additionally to reduce the exhaust gas pressure at the rear end of the boss 2, as compared with that of the first example shown in FIGS. 1(A) and (B).

In this second example, however, there exists another problem in that the trumpet-shaped boss end 5 increases fluid resistance or propulsion resistance and therefore the propulsion efficiency is deteriorated.

FIGS. 3(A) and 3(B) shows an example of prior-art motorboat propeller provided with a boss cap 6 instead of the hollow boss. In the propeller provided with the boss cap 6, since there exists a problem in that a vortex 8 is readily produced behind the boss 2, the boss cap 6 is formed with a plurality (four in FIG. 3(B)) of (fluid flow) straightening fins 7 which guide fluid flow in such a direction that the vortex 8 produced behind the boss cap 6 can be reduced in order to increase the propulsion efficiency. However, the prior-art propeller formed with the fins or subblades 7 as shown in FIGS. 3(A) and (B) is different from the prior-art propellers formed with a cylindrical hollow boss which produces less vortex in general.

SUMMARY OF THE INVENTION

With the problems in mind, therefore, it is the primary object of the present invention to provide a high-speed motorboat propeller of higher propulsion efficiency without increasing fluid resistance.

To achieve the above-mentioned object, the motorboat propeller according to the present invention comprises: (a) a cylindrical boss formed with an engine exhaust gas passage; (b) a plurality of main blades arranged at regular angular intervals on an outer surface of said cylindrical boss at a blade pitch angle with respect to a generatrix on the boss outer surface; and (c) a plurality of subblades also arranged at regular angular intervals on a rearward outer surface of said cylindrical boss at the same blade pitch angle as that of the main blade and between said two adjacent main blades. The subblade is so provided between said two adjacent main blades that a positive pressure domain produced by said subblade reduces a negative pressure domain produced by said main blade to prevent upstream flow of engine exhaust gas educed through the boss exhaust gas passage. In more detail, the subblade is located on the rearward outer surface of said boss at such a position that a rearmost and of said subblade and a frontmost end of said main blade are roughly arranged on the same generatrix on the boss outer surface. Further, a single or plural subblades are provided between the two adjacent main blades. The shape of the subblade is similar to that of the main blade.

In the motorboat propeller according to the present invention, since at least one subblade is so provided between the two adjacent main blades that a positive pressure domain produced by the subblade reduces a negative pressure domain produced by the main blade, it is possible to effectively prevent engine exhaust gas from flowing upstream along the outer surface of the boss, without forming a trumpet-shaped boss end which increases fluid resistance of the boss.

Additionally, since the subblades reduce the total positive pressure (behind the propeller) of negative pressure due to the cylindrical boss, negative pressure due to blade centrifugal acceleration, and positive pressure due to blade propulsion, it is possible to relatively reduce the engine exhaust gas pressure behind the propeller and therefore increase the engine power, so that it is possible to improve the propeller propulsion performance and therefore the motorboat acceleration performance when the propeller is mounted on a motorboat, in practice.

BRIEF DESCRIPTION OF THE DRAWINGS

FIG. 9(A) is a table 1 listing the total positive pressure behind the propeller in comparison between the two prior-art example propellers and the invention propeller;

FIG. 9(B) is a table 2 listing actual exhaust gas pressure values (Hg mm) in comparison between the two prior-art example propellers and the invention propeller;

FIG. 9(C) is a table 3 listing the total propeller performance in comparison between the two prior-art example propellers and the invention propeller;

DETAILED DESCRIPTION OF THE PREFERRED EMBODIMENTS

A first embodiment of the high-speed motorboat propeller according to the present invention will be described in detail with reference to the attached drawings. The feature of the propeller according to the present invention is to provide a plurality of subblades between two adjacent main blades in order to prevent exhaust gas from flowing upstream, without forming a trumpet-shaped boss end, and further to reduce the total positive pressure behind the propeller.

Figure 4A:
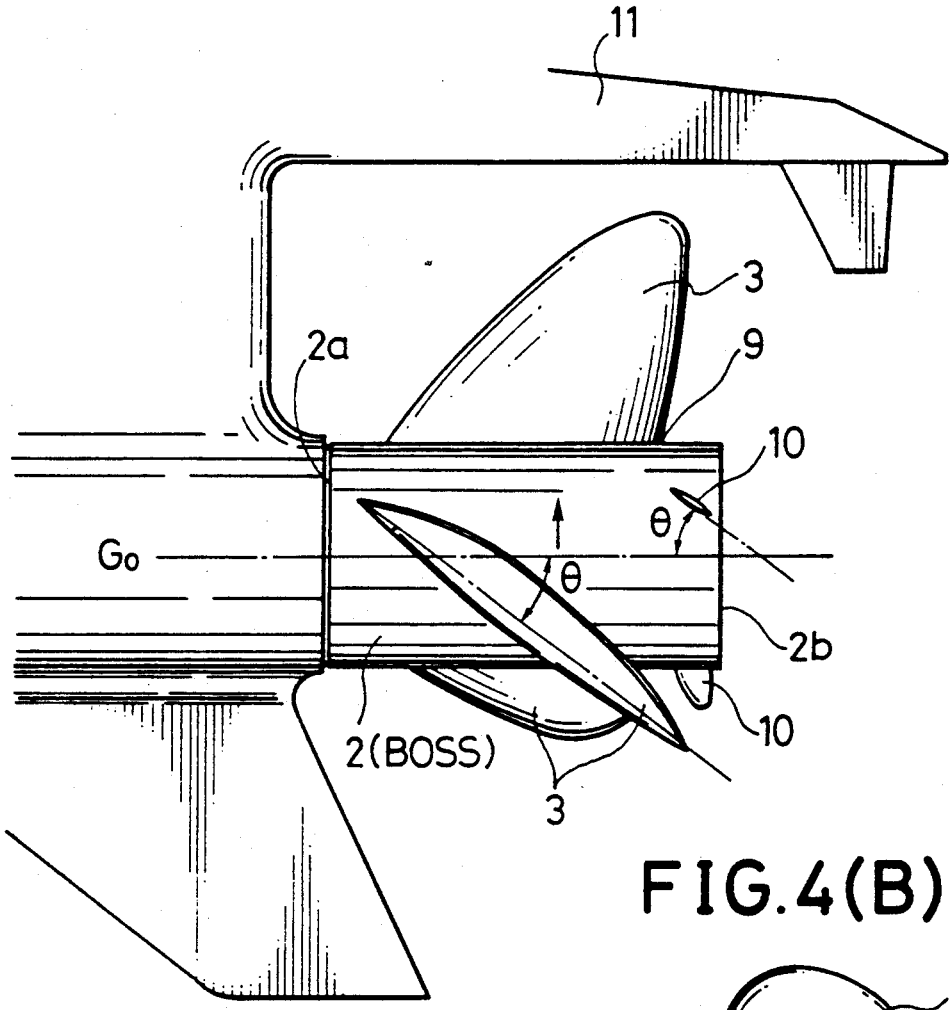
FIG. 4(A) is a side view showing a first embodiment of the high-speed motorboat propeller formed with an engine exhaust gas passage according to the present invention.
Figure 4B:
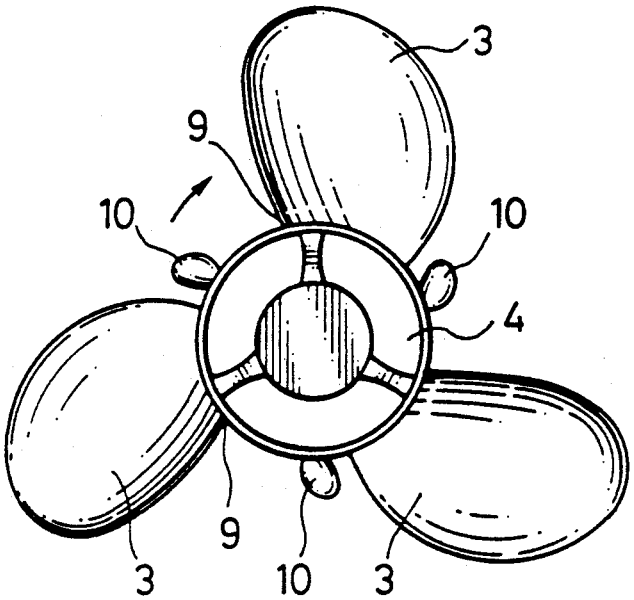
FIG. 4(B) is a rear view showing the same propeller shown in FIG. 4(A)
Figure 4C:
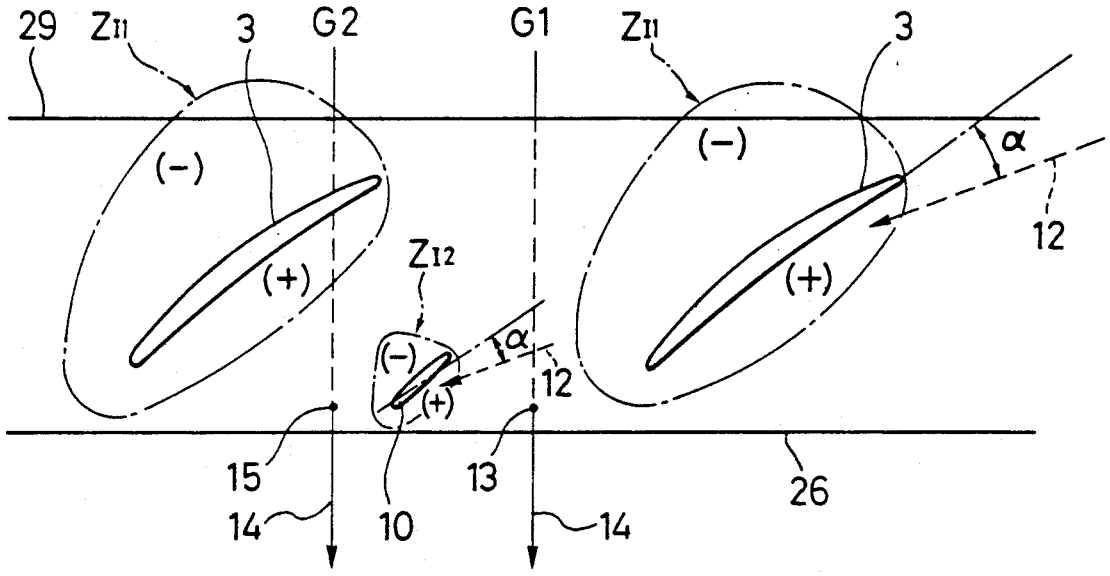
FIG. 4(C) is a similar development view, for assistance in explaining a large negative and positive pressure deviation domain $Z_{I1}$ produced around each blade and a small similar pressure deviation domain $Z_{I2}$ produced around each subblade both enclosed by a dot-dashed curve, respectively.

With reference to FIGS. 4(A) and (B), the propeller according to the present invention comprises a cylindrical boss 2 having almost the same uniform diameters extending between the front end 2*a* and the rear end 2*b*, three main blades 3 arranged at regular angular intervals on the outer surface of the cylindrical boss 2 at a pitch angle $\theta$ with respect to a generatrix $G_0$, and three subblades 10 also arranged at regular angular intervals on the rearward outer surface of the cylindrical boss 2 at roughly the same pitch angle $\theta$ (a certain difference (20 degrees or less) in pitch angle $\theta$ between the main blade and the subblade is allowable) and at three intermediate angular positions between two adjacent rearmost end portions 9 of the main blade 3. As shown in FIG. 4(C), it is preferable that the subblade is so provided between the two adjacent main blades that a positive pressure domain produced by the subblade can effectively reduce a negative pressure domain produced by the main blade to prevent upstream flow of engine exhaust gas educed through the boss exhaust gas passage. In practice, the subblade is located on the rearward outer surface of the boss at such a position that a rearmost end of the subblade and a frontmost end of the main blade are roughly arranged on the same generatrix on the boss outer surface. Further, in FIG. 4(A), the reference numeral 11 denotes a stern drive unit mounted on the rearmost end of a motorboat.

The aspect ratio (a ratio of height to width) or the shape of the subblade 10 is roughly the same as that of the main blade 3. In other words, the subblade 10 is similar to the main blade 3 in shape (similar figures) and the size ratio of the subblade to the main blade is from 1/5 to 1/6.

Figure 5A:
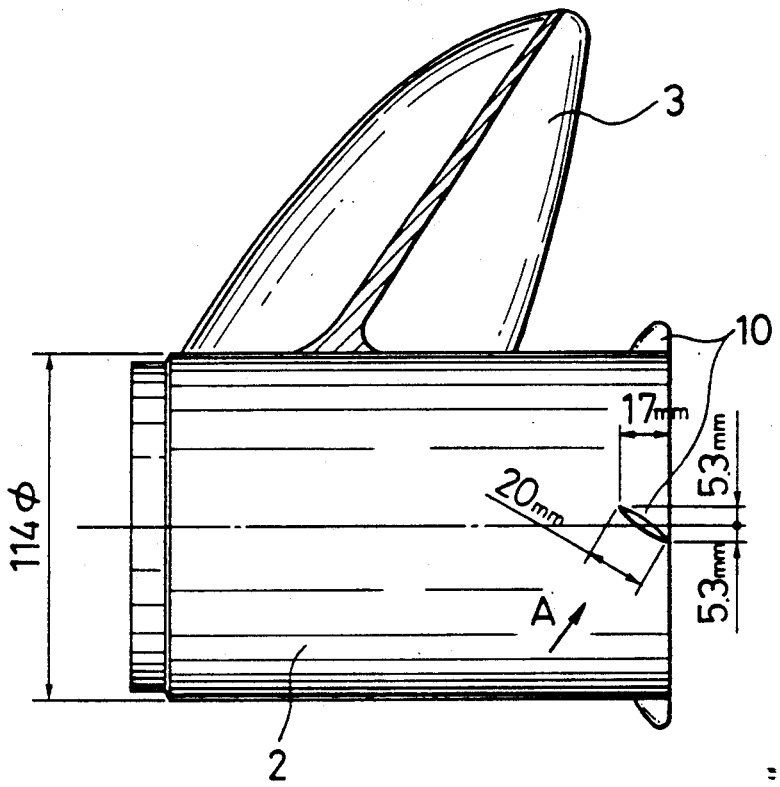
FIG. 5(A) is a side view similar to FIG. 4(A), in which actual dimensions of each subblade are entered.
Figure 5B:
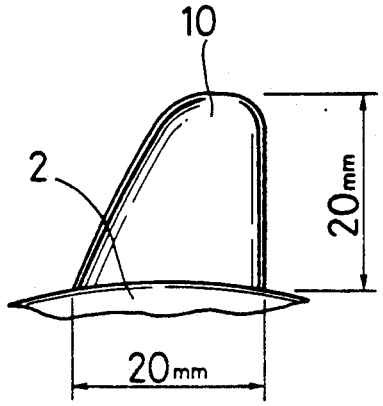
FIG. 5(B) is an enlarged side view showing a subblade when seen from the arrow direction A shown in FIG. 5(A), in which an actual subblade height and width are entered.

FIGS. 5(A) and (B) show an example of actual dimensions of the subblade 10, in which a subblades 10 with a height and a width of both 20 mm (the aspect ratio is 1) are attached to the boss 2 with a diameter 114 mm.

The propeller formed with three subblades according to the present invention has three advantages of (1) a small fluid resistance; (2) no upstream exhaust gas flow; and (3) a low exhaust pressure and high engine power as explained in further detail below:

(1) Small fluid resistance

Figure 2A:
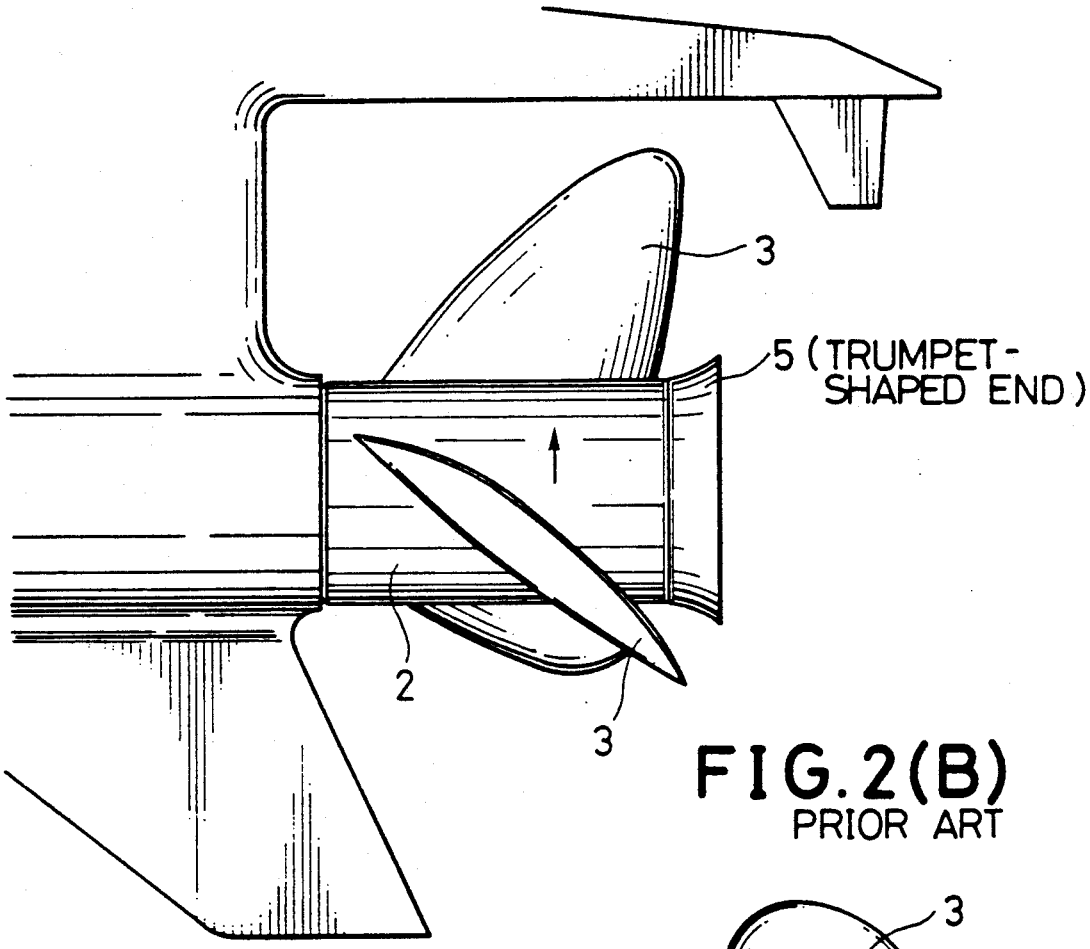
FIG. 2(A) PRIOR ART
FIG. 2(A) is a side view showing a second example of prior-art motorboat propellers formed with an exhaust boss.
Figure 2B:
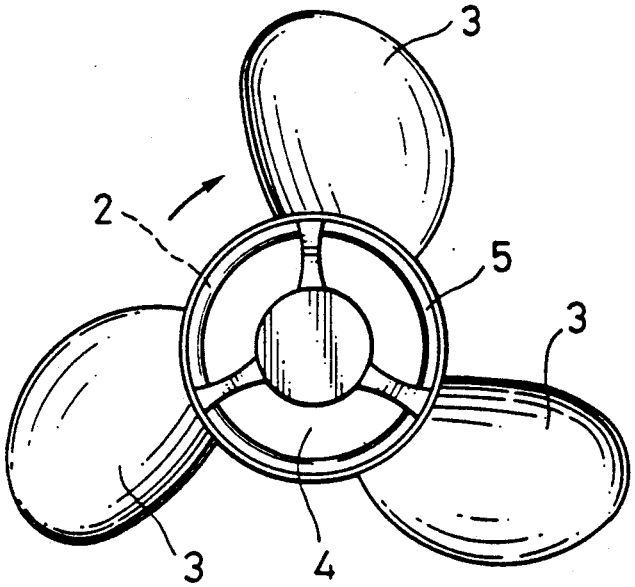
FIG. 2(B) PRIOR ART
FIG. 2(B) is a rear view of the same propeller shown FIG. 2(A)
Figure 2C:
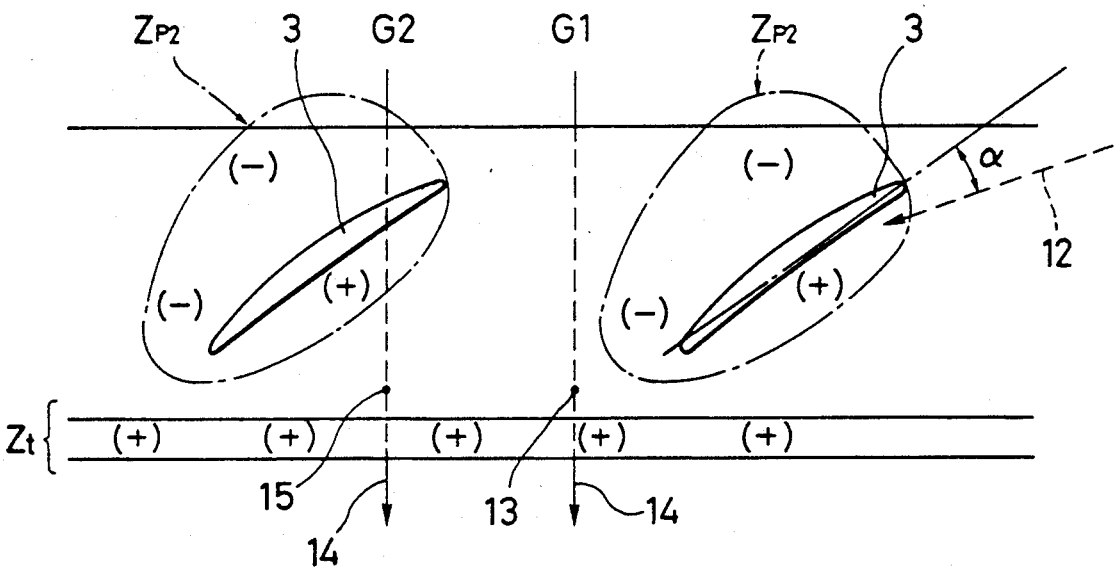
FIG. 2(C) PRIOR ART
FIG. 2(C) is a similar development view, for assistance in explaining negative and positive pressure deviation domain $Z_{p2}$ produced around each blade and enclosed by a dot-dashed curve and a positive pressure deviation domain $Z_t$ produced along the rearmost boss end circumference and indicated by a solid line.
Figure 3A:
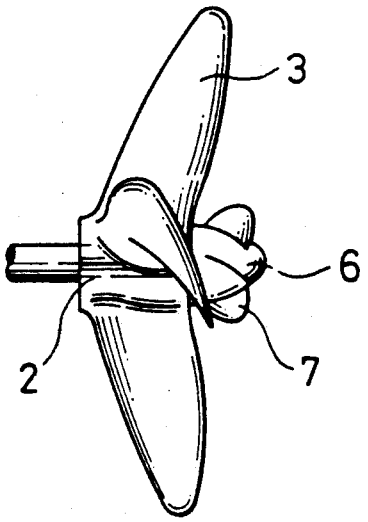
FIG.3(A) PRIOR ART
FIG. 3(A) is a side view showing another example of prior-art motorboat propellers formed with a boss cap on which subblades are formed, instead of the exhaust gas passage.
Figure 3B:
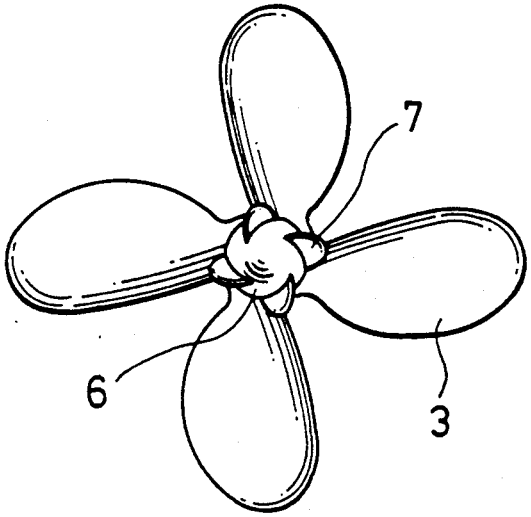
FIG.3(B) PRIOR ART
FIG. 3(B) is a rear view of the same propeller shown in FIG. 3(A)
Figure 3C:
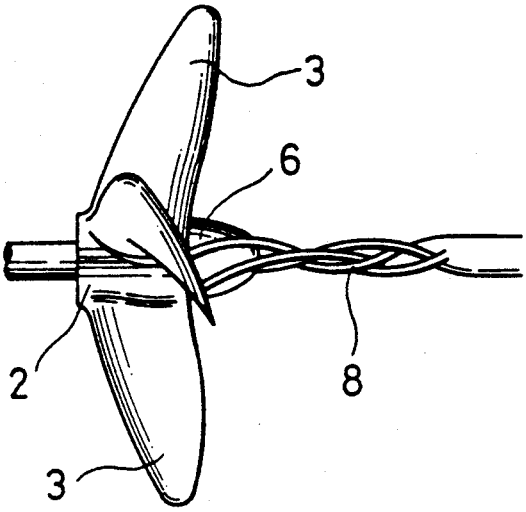
FIG.3(C) PRIOR ART
FIG. 3(C) is a side view showing a prior-art propeller formed with a boss cap on which no subblades are formed, for assistance in explaining the occurrence of vortex behind the propeller.

Since the boss 2 is formed into a cylindrical shape; that is, the boss diameter is almost equal at both the boss front and rear ends 2*a* and 2*b*, the fluid resistance is small, as compared with the propeller formed with a trumped-shaped end boss as explained in the second prior-art example shown in FIGS. 2(A) and 2(B).

(2) No upstream exhaust gas flow

FIG. 4(C) shows a development view taken along the outer circumferential surface of the boss 2, in which water 12 flows against the main blade 3 at an elevation angle $\alpha$ with respect to the blade 3 when the blade 3 is assured to be fixed. In FIG. 4(C), $Z_{I1}$ denotes a large deviation pressure distribution domain in which negative (−) and positive (+) pressure deviated from the roughly atmospheric pressure is produced around the main blade 3 by water 2 flowing against the main blade. Further, $Z_{I2}$ denotes a small deviation pressure distribution domain in which negative (−) and positive (+) pressure is produced around the subblade 10 by water 12 flowing against the subblade 10 also at roughly the same elevation angle $\alpha$.

Figure 1A:
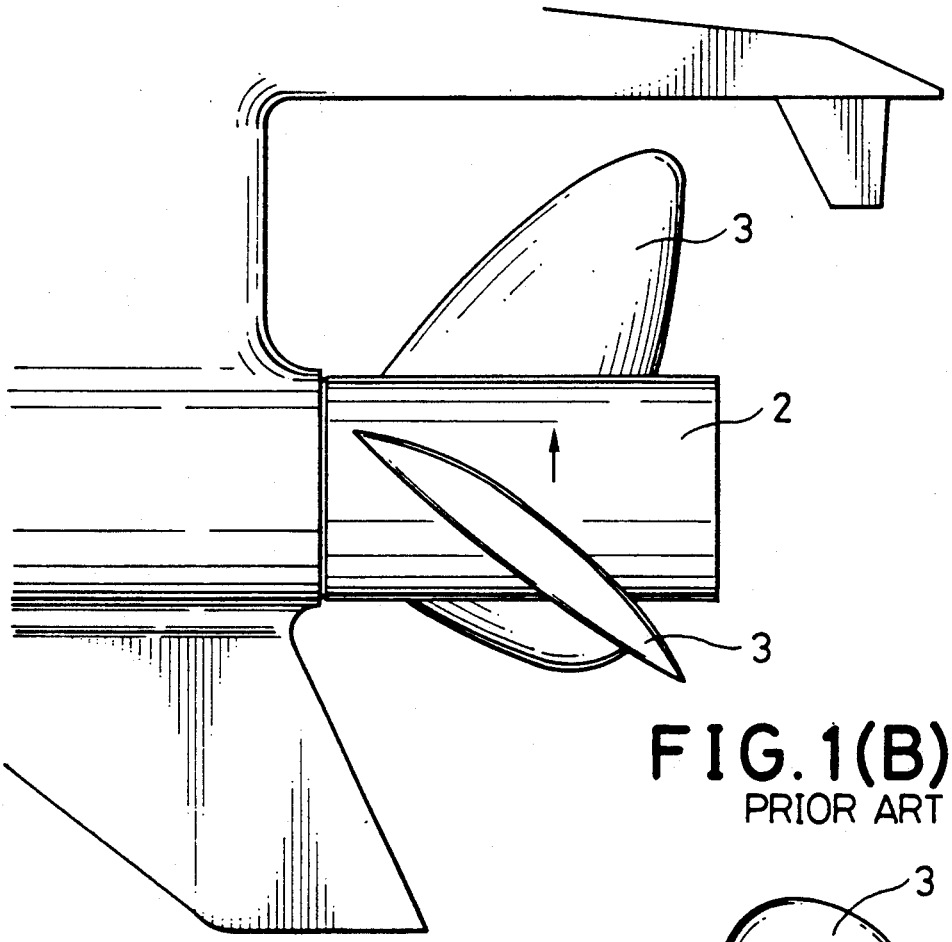
FIG.1(A) PRIOR ART
FIG. 1(A) is a side view showing a first example of prior-art motorboat propellers formed with an exhaust boss.
Figure 1B:
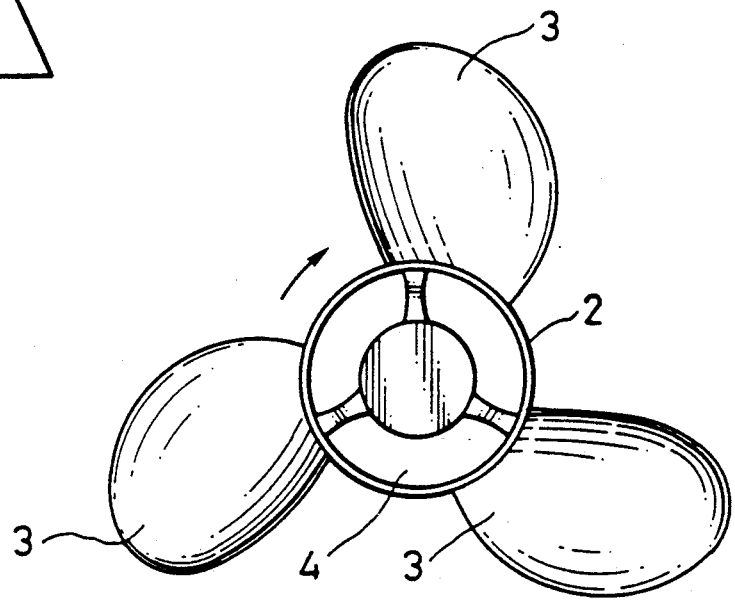
FIG.1(B) PRIOR ART
FIG. 1(B) is a rear view of the same propeller shown in FIG. 1(A)

In FIG. 4(C), since an additional small deviation pressure distribution domain $Z_{I2}$ is produced by the subblade 10, it is possible to decrease the area of the large deviation pressure distribution domain $Z_{I1}$ around the main blade 3 by pressure interference between the two small and large domains $Z_{I1}$ and $Z_{I2}$ or to eliminate the negative pressure domain near the point 13, as compared with the propeller formed with no subblades explained as the first prior-art example shown in FIGS. 1(A) and (B).

Figure 1C:
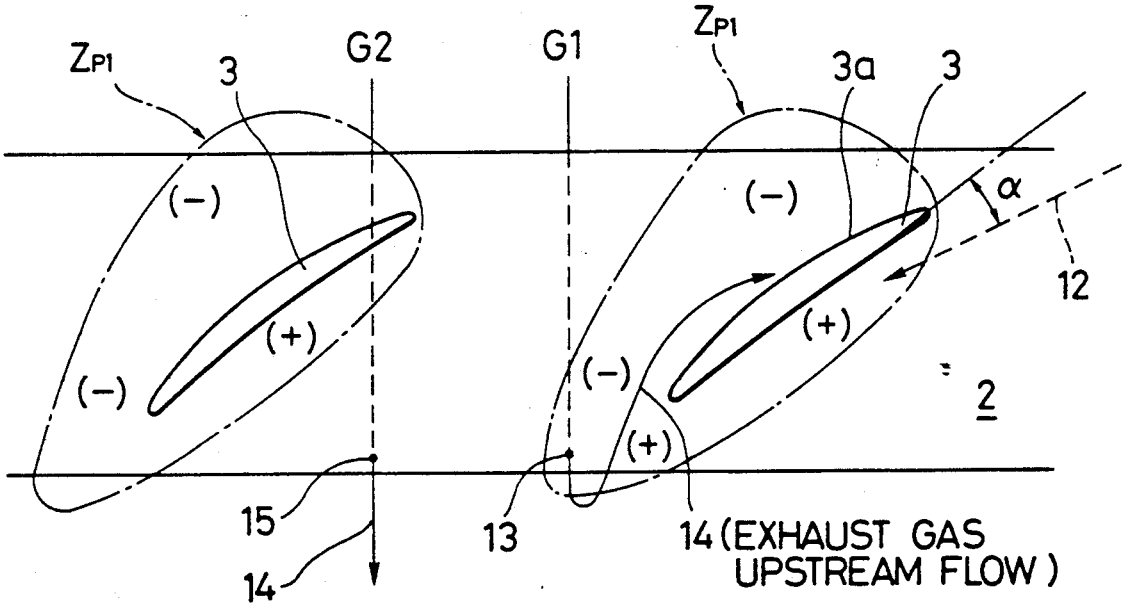
FIG.1(C) PRIOR ART
FIG. 1(C) is an development view taken along the outer circumferential surface of the boss, for assistance in explaining a negative and positive pressure deviation domain $Z_{p1}$ produced around each blade and enclosed by a dot-dashed curve.

Therefore, it is possible to allow the exhaust gas flow 14 educed from the rearmost end of the boss 2 through a point 13 to more smoothly flow straight toward the downstream direction without allowing the exhaust gas 14 to flow upstream and further into the backside of the main blade 3 as in the first prior-art example shown in FIG. 1(C). As a result, it is possible to increase the propulsion efficiency. In this connection, exhaust gas flow 14 along the generatrix G2 on the outer surface of the boss 2 through a point 15 can smoothly flow in the downstream direction.

(3) Low exhaust pressure and high engine power

Figure 6A:
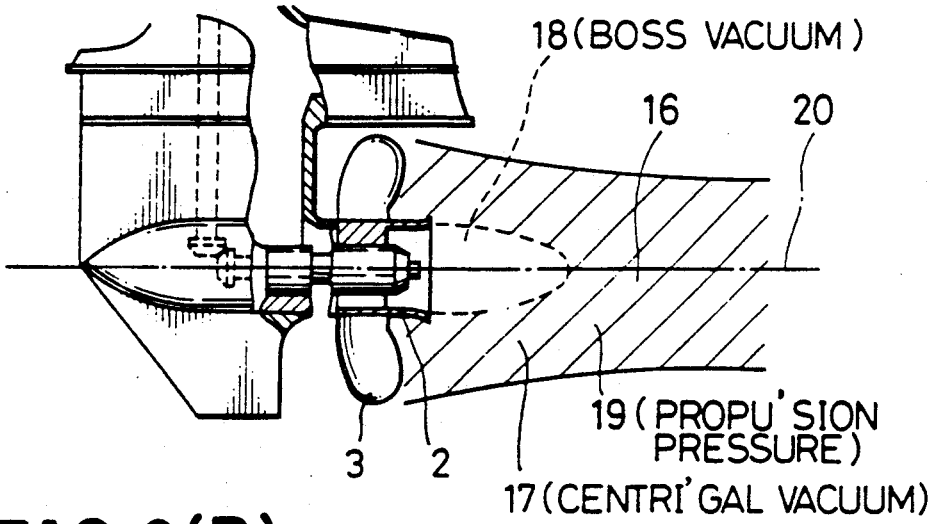
FIG. 6(A) is a side view for assistance in explaining a fluid stream behind the propeller.

As shown in FIG. 6(A), there exist a negative pressure (vacuum) domain 18 due to the boss 2, a negative pressure (vacuum) domain 17 due to centrifugal acceleration of the rotating blade 3, and a positive blade propulsion pressure domain 19 in combination, behind the propeller. Therefore, the lower the total of these three pressures, the more easily the exhaust gas will be exhausted through the boss 2.

The above-mentioned three pressures will be explained in further detail below with reference to the attached drawings:

(a) Negative pressure due to cylindrical boss

A boss negative pressure domain 18 as shown by a dashed carve in FIG. 6(A) is produced just behind the boss 2, because the boss 2 is formed into a cylindrical shape or not formed into a streamline shape toward the rearward direction.

(b) Negative pressure due to blade centrifugal acceleration

Figure 6B:
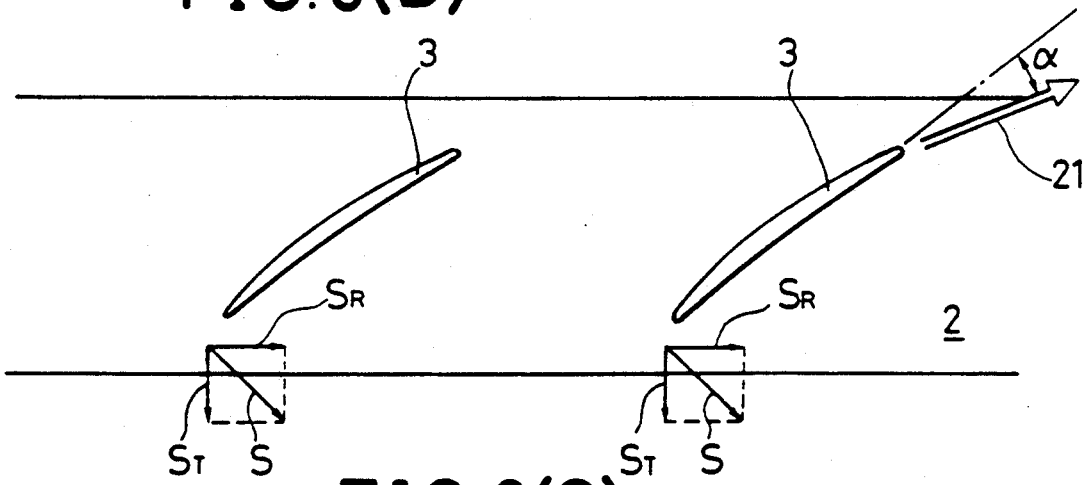
FIG. 6(B) is a development view, for assistance in explaining a centrifugal acceleration generated behind the propeller by each main blade.

An assumption is made that the blade 3 moves in the thick arrow direction 21 within stationary water as shown in FIG. 6(B). In this case, an induced velocity S is generated in a stream 16 behind the propeller after the blade 3 has passed. A circumferential velocity component $S_R$ of this induced velocity S rotates the stream 16 behind the propeller in the same rotative direction as that of the blade 3, so that the stream 16 rotates behind the propeller with the axis 20 as its center into a cylindrical and conical shape. Therefore, a centrifugal acceleration is generated behind the propeller. Further, in FIG. 6(B), $S_T$ denotes an axial velocity component of this induced velocity S. The strong negative pressure 17 due to blade centrifugal acceleration decreases gradually along the axial line 20 of the propeller's rear stream 16 until the induced velocity S or the axial velocity $S_T$ attenuates down to zero.

Figure 6C:
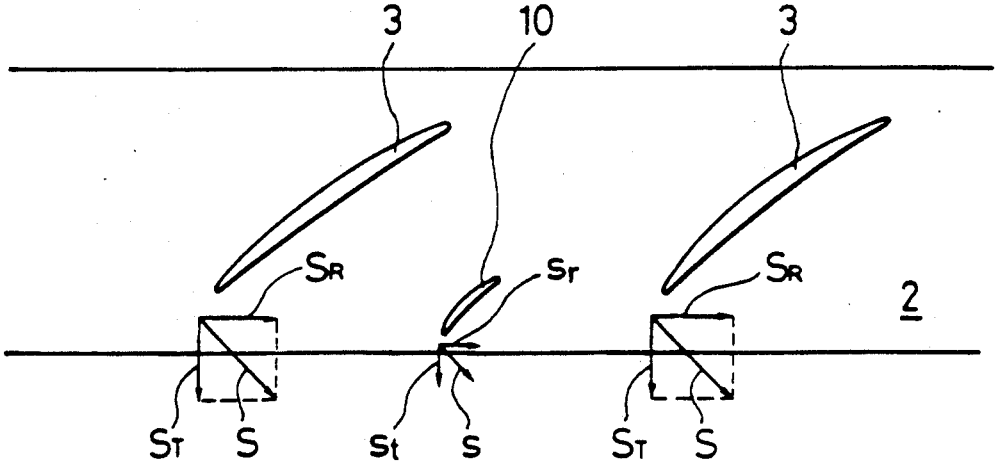
FIG. 6(C) is a development view, for assistance in explaining a centrifugal acceleration generated behind the propeller by each main blade and each subblade, respectively.

FIG. 6(C) shows the similar diagram for assistance in explaining the induced velocity s of a subblade 10 attached to the propeller according to the present invention. Since the subblade 10 is attached to the boss 2 at roughly the same pitch angle $\theta$ as that of the main blade 3, the direction of the induced velocity s in the rear stream 16 generated by the subblade 10 is in parallel to that of the induced velocity S in the rear stream 16 generated by the main blade 3. As a result, since the circumferential velocity component $s_r$ of the induced velocity s is added to that $S_R$ of the induced velocity S, it is possible to increase the centrifugal acceleration of the rear stream 16, so that the negative pressure 17 due to the centrifugal acceleration also increases.

(c) Positive pressure due to blade propulsion

Positive pressure due to blade propulsion is produced by the axial component $S_T$ of the induced velocity S generated by the main blade 3 within a domain 19 as shown by a shaded portion in FIG. 6(A). Therefore, the positive propulsion pressure domain 19 is substantially the same as the negative centrifugal acceleration domain 17. In the present invention, since the subblades 10 are additionally attached, it is possible to increase the positive propulsion pressure in the same way as in the negative centrifugal acceleration pressure.

Table 1 shown in FIG. 9(A) lists the above-mentioned three pressures and the total positive pressure behind the propeller in comparison between the two prior-art examples and the invention. This table 1 indicates that: (1) the propeller of the second prior-art example II is large in the negative boss pressure and therefore preferable in exhaust gas eduction; (2) the propeller of the present invention is large in the negative centrifugal acceleration pressure, in particular and therefore preferable in exhaust gas eduction; (3) the propellers of the second prior-art example II and the present invention are small in the total positive pressure behind the propeller and therefore preferable in exhaust gas eduction.

Figure 7:
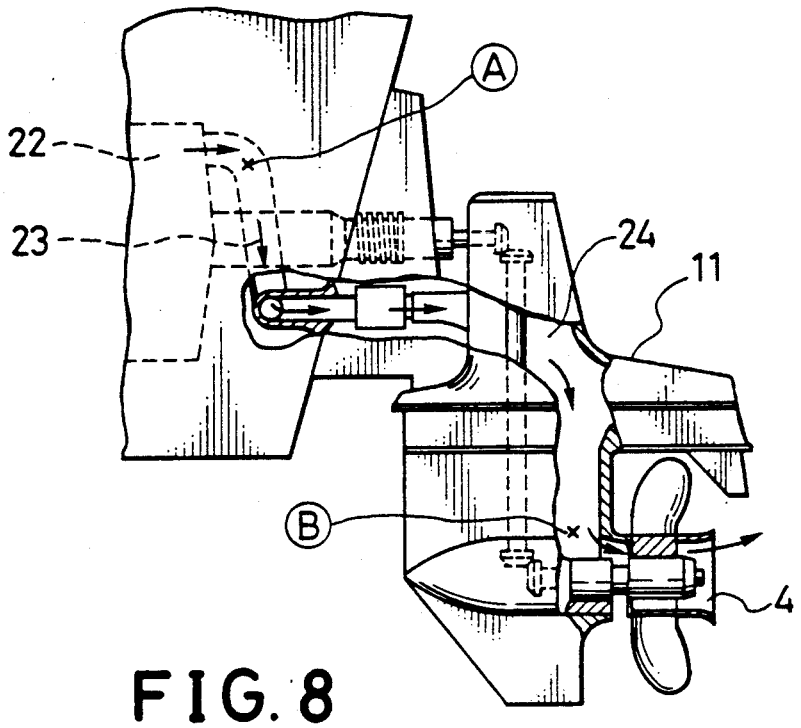
FIG. 7 is a side, partially cross-sectional view in which two measurement points A and B where exhaust gas pressure was actually measured are indicated.

To verify the above effect, experiment has been made by the method as shown in FIG. 7, in which a stern drive unit 11 was driven by an engine 22 and a test propeller was mounted on the stern drive unit 11. Exhaust gas was educed from the engine 22 into water through a first exhaust pipe 22, a second exhaust pipe 24, and the propeller exhaust passage 4. The exhaust gas pressure was measured at two different test points of a point A located within the first exhaust pipe 23 and near the engine 22 and a point B located within the second exhaust pipe 24 and near the propeller exhaust passage 4.

Table 2 shown in FIG. 9(B) lists the actually measured pressure values at these two test points A and B and the difference between the two points in comparison between the prior-art propellers and the invention propeller. This table 2 indicates that: (1) the propeller of the first prior-art example I is small in pressure difference between the two points and therefore the exhaust gas is not effectively educed from the propeller exhaust passage 4; (2) the propeller of the second prior-art example II is medium in the pressure difference and therefore the exhaust gas is fairly effectively educed from the propeller exhaust passage 4; and (3) the propeller of the present invention is large in the pressure difference and therefore the exhaust gas is the most effectively educed from the propeller exhaust passage 4. In other words, the total pressure behind the propeller is the lowest within steam behind the propeller in the present invention, and therefore it is possible to verify the effect of the presence of the subblades 10 on the basis of the above test results.

Table 3 shown in FIG. 9(C) lists the total propeller performance in comparison between the two prior-art examples and the invention. This table 3 indicates that: (1) the total propeller performance of the first prior-art example 1 is poor because exhaust gas flows upstream and further the total positive pressure behind the propeller is not sufficiently low, although the fluid or boss resistance is preferably small; (2) that of the second prior-art example 2 is intermediate because exhaust gas will not flow upstream and further the total positive pressure behind the propeller is sufficiently low, although the fluid (boss) resistance is high; and (3) that of the present invention is good because the fluid (boss) resistance is small, exhaust gas will not flow upstream, and the total pressure behind the propeller is preferably low, as compared with the two prior-art examples 1 and 2.

Figure 8:
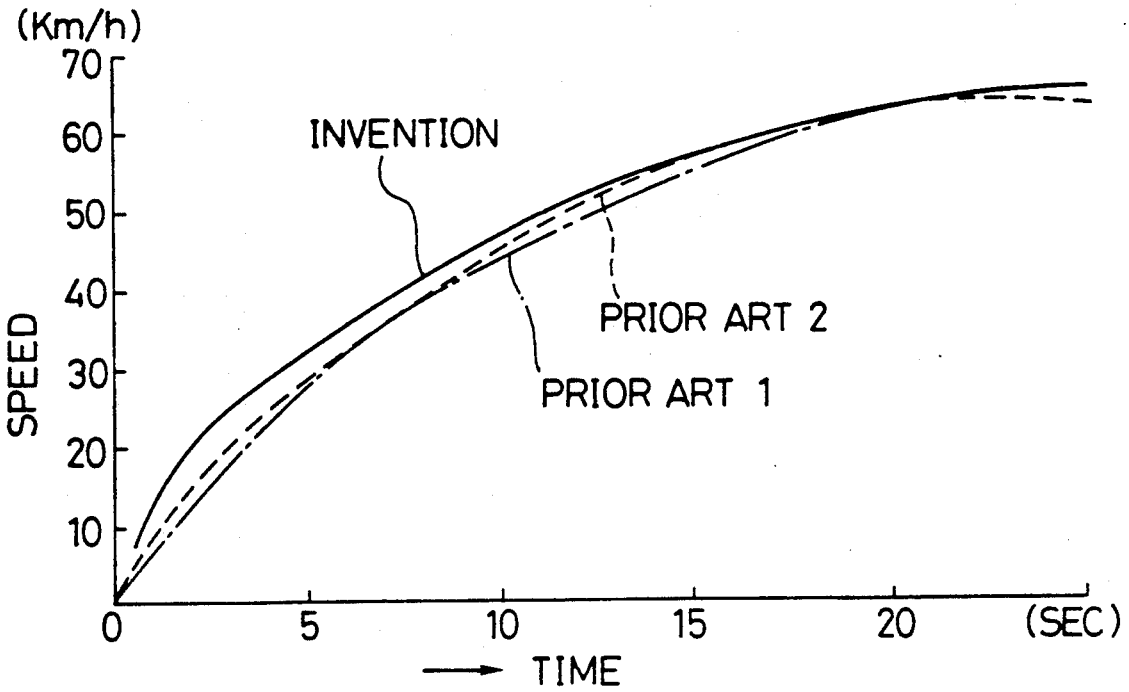
FIG. 8 is a graphical representation showing acceleration performance of three motorboats on which the two prior-art propellers shown in FIGS. 1 and 2 and the invention propeller shown in FIG. 5 are actually mounted.

FIG. 8 is a graph showing actual speed and acceleration test results of the propellers of the two prior-art examples 1 and 2 and the present invention, which was obtained by mounting the propellers on an actual stern drive unit of a motorboat as shown in FIG. 7. FIG. 8 indicates that the propeller of the present invention is the best and that of the first prior-art example 2 is superior to that of the first prior-art example 1 in speed or acceleration performance. This graph also verifies the effect of the presence of the subblades 10.

Figure 10A:
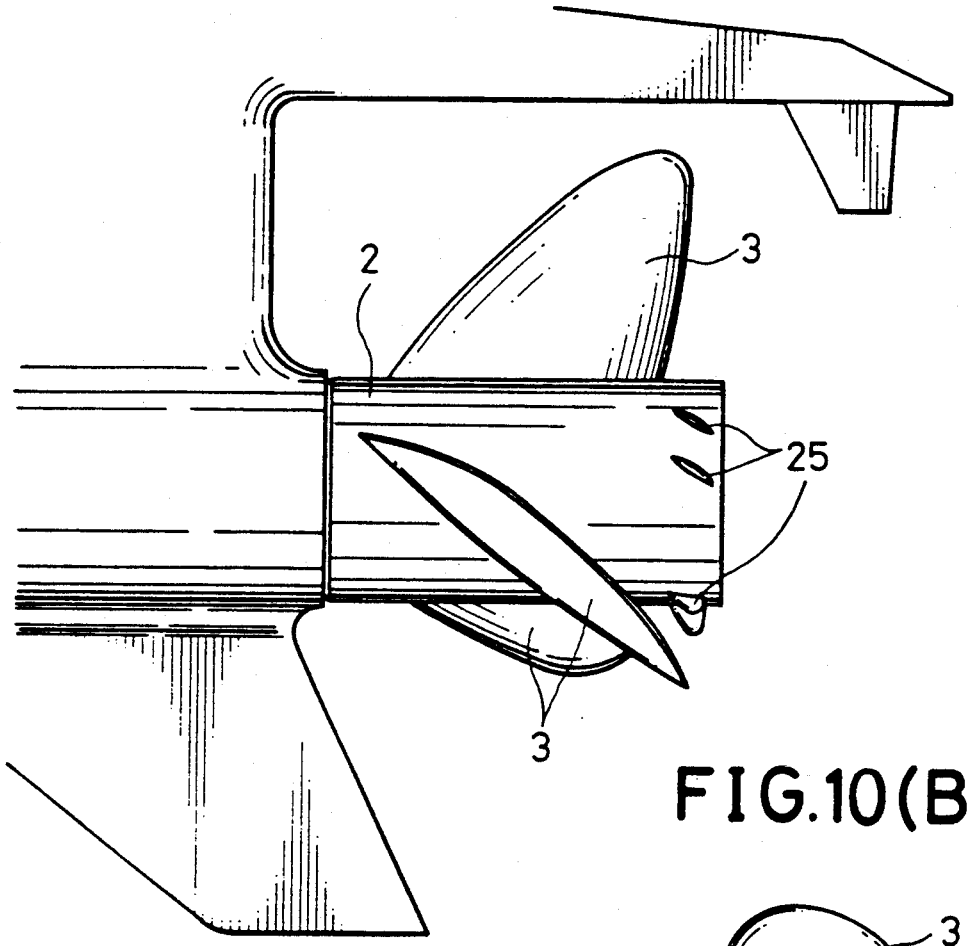
FIG. 10(A) is a side view showing a second embodiment of the motorboat propeller according to the present invention.
Figure 10B:
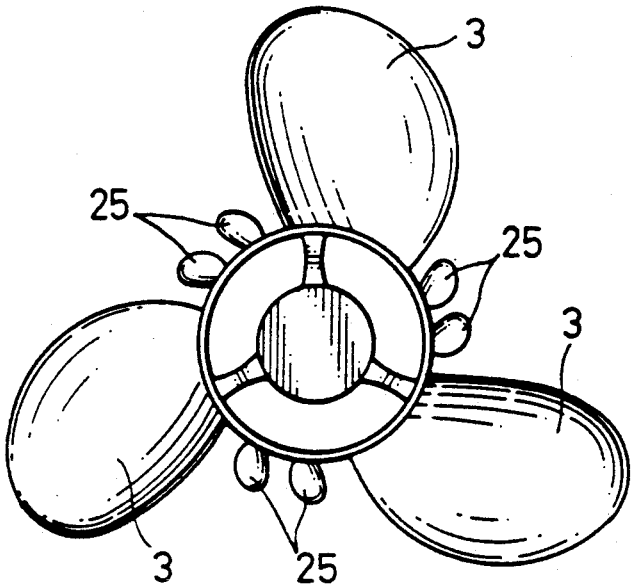
FIG. 10(B) is a rear view showing the same propeller shown in FIG. 10(A).

FIGS. 10(A) and (B) show a second embodiment of the present invention, in which six subblades 25 whose dimensions are smaller than those of the subblade 10 shown in FIGS. 4(A) and (B) and FIGS. 5(A) and (B) are attached between two adjacent main blades 3. The shape of each of these subblades 25 is also similar to that of the main blade 3. Without being limited to six subblades, however, it is also possible to attach a plurality of subblades of any given size similar to the main blade at appropriate position between the two adjacent main blades. When the number of the subblades 25 is increased, it is possible to more finely reduce the negative measure (vacuum) domains on the outer surface of the boss and therefore to more securely present upstream exhaust gas flow. Further, when the number of the subblades is increased, it is also possible to increase the negative centrifugal acceleration pressure and therefore to reduce the total positive pressure behind the propeller for facilitating exhaust gas eduction.

As described above, in the propeller according to the present invention, since a plurality of subblades are additionally attached between the two adjacent main blades, it is possible to effectively prevent exhaust gas from flowing upstream along the outer circumferential surface of the boss, without forming a trumpet-shaped boss end (which increases fluid resistance). Further, since the subblades increase the negative centrifugal acceleration pressure and therefore decrease the total positive pressure behind the propeller (which facilitates eduction of exhaust gas), it is possible to improve the propeller propulsion performance and therefore the motorboat acceleration performance.

What is claimed is:

1. A motorboat propeller, comprising:

(a) a cylindrical boss formed with an engine exhaust gas passage;

(b) a plurality of main blades arranged at regular angular intervals on an outer surface of said cylindrical boss at a blade pitch angle with respect to a generatrix on the boss outer surface; and (c) a plurality of subblades also arranged at regular angular intervals on a rearward outer surface of said cylindrical boss at roughly the same blade pitch angle as that of the main blade and between said two adjacent main blades at such a position that a rearmost end of said subblade and a frontmost end of said main blades are roughly located near the same generatrix on the boss outer surface, wherein a positive pressure produced on a downstream side of said subblade reduces a negative pressure produced on an upstream side of said main blade thereby preventing an upstream flow of engine exhaust gas which is educed through the boss exhaust gas passage.

2. The motorboat propeller of claim 1, wherein a single subblade is provided between said two adjacent main blades.

3. The motorboat propeller of claim 2, wherein a dimensional ratio of said subblade to said main blade is from 1/5 to 1/6.

4. The motorboat propeller of claim 2, wherein a ratio of subblade height to a boss diameter is approximately from 1/5 to 1/6.

5. The motorboat propeller of claim 1, wherein a plurality of subblades are provided between said two adjacent main blades.

6. The motorboat propeller of claim 5, wherein a dimensional ratio of said subblade to said main blade is less than 1/6.

7. The motorboat propeller of claim 5, wherein a ratio of subblade height to a boss diameter is less than 1/6.

* * * * *